United States Patent [19]

Tardif

[11] Patent Number: 4,631,747

[45] Date of Patent: Dec. 23, 1986

[54] DIGITAL SOUND SYNTHESIZER

[75] Inventor: Arthur J. Tardif, Warren, R.I.

[73] Assignee: Raytheon Company, Lexington, Mass.

[21] Appl. No.: 834,139

[22] Filed: Feb. 24, 1986

Related U.S. Application Data

[63] Continuation of Ser. No. 674,365, Nov. 26, 1984, abandoned, which is a continuation of Ser. No. 549,016, Nov. 4, 1983, abandoned, which is a continuation of Ser. No. 417,732, Sep. 13, 1982, abandoned, which is a continuation of Ser. No. 252,966, Apr. 10, 1981, abandoned, which is a continuation of Ser. No. 85,166, Oct. 15, 1979, abandoned, which is a continuation of Ser. No. 925,130, Jul. 17, 1978, abandoned.

[51] Int. Cl.[4] ..... G10L 5/00

[52] U.S. Cl. ..... 381/51; 84/1.01

[58] Field of Search ..... 381/51–53; 84/1.01, 1.24

[56] References Cited

U.S. PATENT DOCUMENTS

| | | | |
|---|---|---|---|
| 3,818,478 | 6/1974 | Groginsky | 343/106 R X |
| 3,821,714 | 6/1974 | Tomisawa | 340/172.5 |
| 3,878,750 | 4/1975 | Kapps | 84/1.01 |
| 3,913,442 | 10/1975 | Deutsch | 84/1.24 |
| 3,952,623 | 4/1976 | Deutsch | 84/1.25 |
| 3,978,755 | 9/1976 | Woron | 84/1.24 |
| 4,023,454 | 5/1977 | Obayashi et al. | 84/1.01 |
| 4,038,898 | 8/1977 | Kniepkamp et al. | 84/1.24 |

OTHER PUBLICATIONS

J. Tierney, "A Digital Frequency Synthesizer", IEEE Trans. Audio Elec., Mar. 1971, pp. 48–56.

*Primary Examiner*—E. S. Matt Kemeny

*Attorney, Agent, or Firm*—Martin M. Santa; Richard M. Sharkanksy

[57] ABSTRACT

A digital sound synthesizer produces a variable spectral line width to synthesize tones by accumulating phase quanta sequentially for each of a set of tone samples. The rate of accumulation of phase for each tone is randomly altered with preset values of phase increment to broaden the spectral line. The broadened spectral lines provide a display with a spectral presentation of sounds more closely resembling naturally occurring sounds. The embodiment shows how one-hundred non-harmonic frequencies can be generated (using integrator 64), each of which can be independently amplitude controlled and band-width modulation controlled using random deviation of a sine wave.

2 Claims, 1 Drawing Figure

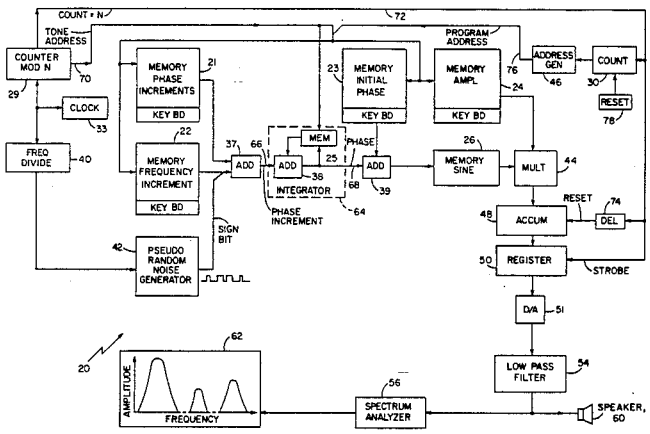

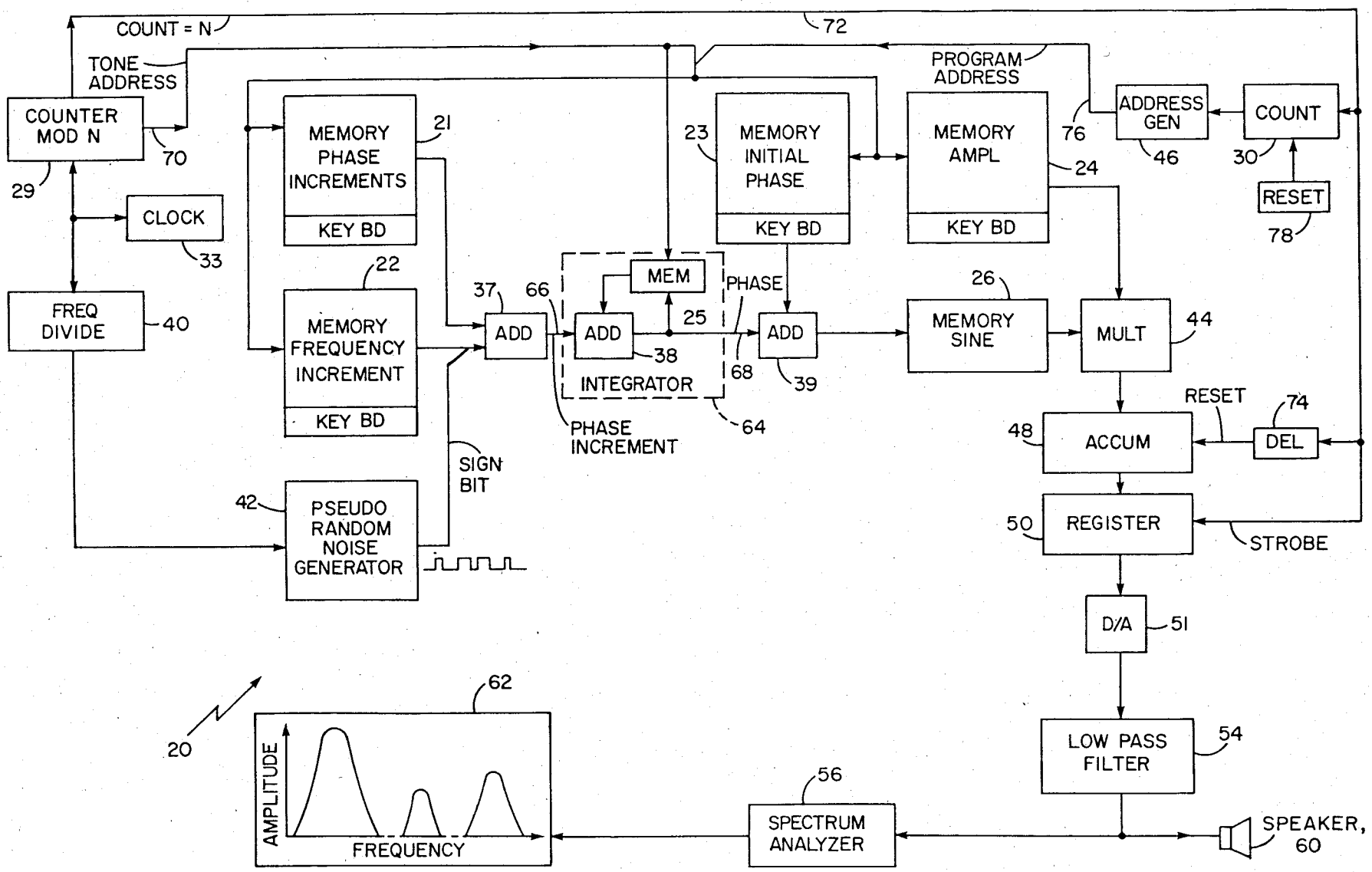
COUNT
30
RESET
78
ADDRESS GEN
46
76
PROGRAM ADDRESS
72
MEMORY AMPL
24
KEY BD
MEMORY INITIAL PHASE
23
KEY BD
MEMORY SINE
26
MULT
44
DEL
74
RESET
ACCUM
48
STROBE
REGISTER
50
D/A
51
LOW PASS FILTER
54
SPEAKER, 60
SPECTRUM ANALYZER
56
ADD
39
PHASE
68
64
MEM
25
ADD
38
INTEGRATOR
PHASE INCREMENT
66
ADD
37
SIGN BIT
MEMORY PHASE INCREMENTS
21
KEY BD
MEMORY FREQUENCY INCREMENT
22
KEY BD
PSEUDO RANDOM NOISE GENERATOR
42
AMPLITUDE
FREQUENCY
62
20
COUNT = N
TONE ADDRESS
COUNTER MOD N
70
29
CLOCK
33
FREQ DIVIDE
40

DIGITAL SOUND SYNTHESIZER

This application is a continuation of application Ser. No. 674,365, filed Nov. 26, 1984, now abandoned, which is a continuation of application Ser. No. 549,016, filed Nov. 4, 1983, now abandoned, which is a continuation of application Ser. No. 417,732, filed Sept. 13, 1982, now abandoned, which is a continuation of application Ser. No. 252,966, filed Apr. 10, 1981, now abandoned, which is a continuation of application Ser. No. 085,166, filed Oct. 15, 1979, now abandoned, which is a continuation of application Ser. No. 925,130, filed July 17, 1978, now abandoned.

BACKGROUND OF THE INVENTION

The digital synthesis of a tone of a specified frequency is described in a paper entitled "A Digital Frequency Synthesizer" by J. Tierney, C. M. Rader and B. Gold which appeared in the IEEE Transactions on Audio Electroacoustics, vol. AU-19, at pages 48–56, in March 1971. The technique described therein utilizes digital techniques followed by analog filtering to produce an analog tone of a prescribed frequency.

It has been found useful to synthesize sounds composed of a plurality of tones for training people to recognize specific sounds. Such sounds may be recognized auditorily as by playing the sounds through a loud speaker, or visually as by passing the sound through a spectrum analyazer and displaying the spectrum to produce a visually identifiable signature of the sound spectrum. For example, such a sound synthesizer may be utilized in the training of automotive mechanics to recognize specific sounds in an automobile engine, which sounds may be masked by other sounds or noise of the engine. Recognition of the specific sounds would be useful in identifying the presence of a specific malfunction in the engine.

A problem has arisen in the past when a sound synthesizer has been utilized with a visible display of the spectral signature due to the fact that a spectral analysis of a naturally occurring sound, such as the sound of an automobile engine, produces relatively broad spectral lines at various ones of the tone frequencies present in the sound. In contrast, the sounds produced by synthesizers of the prior art and composed of a plurality of tone frequencies result in a spectral signature showing relatively sharp spectral lines at the respective tone frequencies. The difference in line width makes recognition of the spectral signature more difficult and decreases the utility of the sound synthesis technique as a means for teaching the identification of specific sound patterns.

SUMMARY OF THE INVENTION

The aforementioned problem is overcome and other advantages are provided by a synthesizer which digitally produces sounds composed of a set of tones and provides a selectably variable spectral line width to the synthesized tones. The phase of each tone is obtained by accumulating phase quants, the value of accumulated phase increasing at a rate proportional to the frequency of each tone. In accordance with the invention, the rate of accumulation of phase for each tone is randomly altered by a preset value of phase increment which is added algebraically to the phase quanta with positive and negative signs of the increment occurring substantially randomly in response to a pseudo-random noise source. The synthesizer produces a plurality of tones simultaneously by providing separate accumulations of quanta of phase for each tone during each sample interval, using the separate accumulations of phase to address a memory for converting the accumulations of phase to samples of sinusoids of the specific tones, and then summing together the respective sinusoids of the tones to provide a sum of tone-like electrical signals which are connected by a speaker to the audible tones. There is also disclosed a multiplier for scaling the amplitudes of the individual tones prior to their summation to produce the output sound signal, as well as a timing circuit including the addressing of a memory for altering the aforesaid magnitude in accordance with a predetermined temporal pattern for the synthesis of a sound more accurately representing a naturally occuring sound.

BRIEF DESCRIPTION OF THE DRAWING

The aforementioned aspects and other features of the invention are explained in the following description taken in connection with the accompanying drawing which shows a block diagram of the sound synthesizer of the invention, the FIGURE showing a pseudo-random noise generator for randomly incrementing the phases of the tones of the sound.

DESCRIPTION OF THE PREFERRED EMBODIMENT

Referring now to the FIGURE, a sound synthesizer 20 comprises, in accordance with the invention, six memories 21–26, counters 29–30, a clock 33, adders 37–39, a frequency divider 40, a pseudo-random noise generator 42, a multiplier 44, an address generator 46, an accumulator 48, a register 50, a digital-to-analog converter 51, a low pass filter 54, a spectrum analyzer 56, a speaker 60 and a display 62. The adder 38 in cooperation with the memory 25 perform the function of an integrator, identified by the legend 64, which converts frequency on line 66 to phase on line 68 for each of the tones produced by the synthesizer 20.

In describing the operation of the synthesizer 20 for the production of a set of tones, an exemplary set of one-hundred tones is assumed with the lowest tone having the frequency of 40 Hz (hertz) and the highest tone having a frequency of 4,000 Hz. Considering first the production of a single tone, namely, the highest tone at 4,000 Hz, digital samples of the tone appear in the register 50 at a rate above the Nyquist sampling rate. The tone samples appearing in the register 50 are then converted by the converter 51 to analog signal samples and filtered by the low pass filter 54 to produce an electrical signal having a sinusoidal waveform at the 4,000 Hz frequency of the highest tone. By way of example, it is assumed that four samples of a tone appear in the register 50 for each cycle of the sinusoidal signal produced by the filter 54. The resulting sampling rate is 16,000 Hz. The magnitude of the sampling rate has been selected on the basis of the frequency of the highest tone, the same sampling rate is to be utilized for synthesizing each of the other ninety-nine tones. The sinusoidal electrical signal representing the 4,000 Hz tone, produced by the filter 54, as well as the corresponding signals representing the other tones, are applied to the speaker 60 to produce an audible sound.

The counter 29 counts modulo N where N is equal to the number of tones, N being equal to 100 for the present exemplary set of one-hundred tones. Each sound produced by the speaker 60 is formed from the set of one-hundred tones wherein the tones are scaled in amplitude by the multiplier 44 to provide a set of amplitude values, including 0, for respective ones of the tones. A scaling factor of 0 is utilized when it is desired that a specific tone is to be absent in the sound produced by the speaker 60. The counter 29 produces an address signal on line 70 for designating sequentially each of the tones in the set of tones, irrespectively of the amplitudes to be impressed upon the tones by the multiplier 44. Thus, the counter 29 cycles repetitively through each of the tone addresses and provides a pulse signal on line 72 upon the completion of each cycle of addressing the tones.

The clock 33 applies clock pulses to the counter 29 at a rate sufficient to provide the aforementioned sampling rate of 16,000 Hz for each of the one-hundred tones. Accordingly, the clock 33 provides pulses at a rate of 1.6 MHz (megahertz). Since the counter counts modulo N, where N=100, the counter 29 cycles through the one-hundred addresses at the aforementioned rate of 16,000 Hz. The tone address on line 70 is applied to each of the memories 21–25, each memory having addresses corresponding to the tone addresses.

With reference to the 4,000 Hz tone, since four samples of the tone are produced during each cycle of the tone, it follows that each sample represents an increment in phase of 90° of the sinusoidal signal appearing at the output of the filter 54. Since the 16,000 Hz sampling rate applies to each of the tones, a tone of 400 Hz, which has a period which is ten times larger than the period of the 4,000 Hz tone, receives 40 sampes per period of the tone wherein each sample represents a phase increment of 9°. For the lowest tone of 40 Hz, wherein the period is one-hundred times longer than the period of the 4,000 Hz tone, there are 400 samples per period of the tone wherein each sample represents a phase increment of 0.9°. The memory 21 provides the requisite phase increments at the 16,000 Hz sample rate for each of the tones in accordance with the addressing of the memory 21 by the address on line 70 from the counter 29. Each of the phase increments is coupled from the memory 21 via the adder 37 to the integrator 64. To facilitate the explanation, it is assumed at this point that the memory 22 and the noise generator 42 are inactive so that the output signal of the adder 37 on line 66 equals the phase increment provided by the memory 21. Thus, for each of the tones being produced, the corresponding phase increment, as represented by the digital signal on line 66, is proportional to the frequency of the tone. As noted hereinabove, in the case of the 40 Hz tone, each phase increment appearing on line 66 has a value of 0.9° while the corresponding phase increment for the 4,000 Hz tone has a value of 90°. The phase increments for both the 40 Hz tone and the 4,000 Hz tone appear at the same sampling rate, namely, the aforementioned 16,000 Hz rate. In view of the fact that the signals on line 66 are proportional to the tone frequency, the input signal to the integrator 64 on line 66 has been designated in the FIGURE as the tone frequency.

The integrator 64 operates as a digital accumulator for summing together, modulo 360°, successively occurring phase increments on line 66 for each of the respective tones. Considering the exemplary tone of 4,000 Hz, a 90° phase increment is added by the adder 38 to a value of phase previously stored in the memory 25. Assuming an exemplary value of zero phase initially stored in the memory 25, the digital signals appearing on line 68 at the output of the integrator 64 have the following set of values for successive samples of the 4,000 Hz tone, namely, 0°, 90°, 180°, 270°, 0°, 90°, . . . wherein the sequence is seen to repeat due to the modulo 360° addition provided by the adder 38. Since the value of the digital signal on line 68 is seen to increase linearly with time in a modulo 360° fashion, it is apparent that the signal on line 68 represents the phase of the corresponding sinusoidal signal at the output of the filter 54.

Since the memory 25 is to be utilized for storing values of phase for each of the one-hundred tones, the memory 25 is provided with one-hundred sections which are sequentially addressed by the address on line 70 in accordance with the particular tone for which a sample is appearing on line 66. Accordingly, the output signal of the adder 38 is coupled into and stored in the specific section of the memory 25 as addressed by the address on line 70. The signal stored in that section of the memory 25 is retained until the counter 29 has completed a full cycle of its counting whereupon the address of the corresponding tone again appears on line 70 so that the previous output signal of the adder 38 as stored in the memory 25 is applied to an input terminal of the adder 38.

The phase angle appearing on line 68 is coupled via the adder 39 to the memory 26 and is converted by the memory 26 to the corresponding value of the sinusoidal signal produced by the filter 54. To facilitate the explanation, it is assumed at this point that the memory 23 is inactive so that the output terminal of the adder 39 shows the same value of phase as is present on line 68. The memory 26 provides a set of values of sine which are addressed by the corresponding phase angles at the output terminal of the adder 39. Thus, for each value of phase angle on line 68, the memory 26 applies the corresponding magnitude of a normalized sinusoid to an input terminal of the multiplier 44 which then scales the normalized value of the sinusoid to produce the desired amplitude for the sinusoidal signal of the filter 54.

In the case where several non-zero values of tones are to be produced, the scaled amplitudes of the samples for each tone are applied by the multiplier 44 to the accumulator 48 which sums together the samples of all the tones produced during one cycling of the counter 29. The memory 24 provides amplitude scale factors for the multiplier 44 for use in scaling the amplitudes of the samples of the respective tones. Thereby, the output signal of the accumulator 48 represents a sample of the sum of the tones in the sound produced by the speaker 60. The sum of the samples of the accumulator 48 is coupled to the register 50 where they are stored to permit the conversion to analog samples by the converter 51. The signal on line 72 serves to strobe the register 50 for receiving the sum of the samples, and to clear the accumulator 48 upon the transfer of the sum of the samples to the register 50. A delay unit 74 delays application of the signal on line 72 for clearing the accumulator 48 until after the strobing of the register 50.

A visual presentation of the spectral signature of the sounds at the speaker 60 is provided by the spectrum analyzer 56 and the display 62. The analyzer 56 provides the spectral data within bands having a width of, for example, one Hz so that the spectral signatures of similar sounds can be distinguished.

The memory 23 provides an initial phase angle to the sinusoidal signals of each of the tones appearing at the output terminal of the filter 54. These phase angles may be inserted directly into the memory 25 prior to the generation of the sound by the synthesizer 20 in the event that these phase angles are to remain unchanged during the entire period of the generation of the sound or, as shown in the FIGURE, may be added to the output signal of the integrator 64 by the adder 39. The use of the adder 39 permits a changing of the phase angle during the generation of the sound and thereby provides the facility for altering a characteristic of the sound. The phase angle of the memory 23 appears as a fixed phase offset in the sequence of phases appearing on line 68 for each tone.

The feature of the invention relating to the broadening of spectral lines appearing on the display 62 is accomplished by the memory 22, the frequency divider 40 and the noise generator 42. The divider 40 divides the aforementioned 1.6 MHz pulse repetition frequency of the clock 33 to produce clock pulses at a pulse repetition frequency of, for example, approximately 40 Hz. The clock pulses from the divider 40 drive the generator 42. The generator 42 produces a pseudo-random noise code in the form of logic signals having states which vary between 0 and 1. The construction of such generators is well known, one such generator being described in FIG. 2 in the U.S. Pat. No. 3,818,478 which issued in the name of H. L. Groginsky on June 18, 1974. The signal produced by the generator 42 serves as a sign bit for the digital signals provided by the memory 22 in response to the addressing thereof by the address on line 70. Since the digital numbers provided for each of the tones by the memory 22 are summed algebraically (either addition or subtraction according to the sign bit) to the digital numbers of the memory 21 by the adder 37, the digital numbers stored in the memory 22 for each of the tones is referred to as a frequency increment. Thus, the frequency increment is applied in a random fashion, with addition and subtraction of the frequency increment averaging out to zero over the total length of the maximal length shift register code of the generator 42. A keyboard on the memory 22 permits entry of individual amounts of frequency increment for each of the tones. The clock pulse frequency applied to the generator 42 is greater than the frequency increment provided by the successive application of phase quanta as designated by the memory 22 to provide a phase modulation index to the noise process which is less than unity. Thereby, a spectral line displayed by the analyzer 56 on the display 62 is uniformly broadened without the appearance of discrete sideband spectral lines. Accordingly, the display 62 shows broadened spectral line patterns which correspond more closely with the spectral signatures obtained from naturally produced sound.

The following is a more detailed illustration of the generation of 40, 400, and 4,000 Hz tones which require phase increments of 0.9, 9, and 90 degrees, respectively, as stated in the preceding paragraphs. Therefore, the numerical values 0.9, 9 and 90 are stored in successive address locations 1, 2, and 3 in memory 21 and therefore provide a corresponding number (phase increment) on line 66 at the output of adder 37 each time these locations 1, 2 and 3 are addressed, respectively. It is assumed for the moment that only sine waves without a broadened spectrum are being generated at speakers 60 and display 62. The counter 29 is providing addresses at a 16,000 Hz rate to memory 21 which has 100 memory addresses. Therefore, each address is read out at 16,000/100=160 Hz rate. Therefore, the phase increment of 0.9 from address location 1 of memory 21 appears 160 times per second at the input of adder 37 and its output 66 identified on the drawing as a phase increment. Immediately following the outputting of the number 0.9, address number 2 is read out and provides the number 9 which appears at the output of adder 37 during those time intervals during which address 2 is being applied to the memory 21. The next number provided by memory 21 at address number 3 is the number 90. Address number 3 is provided during the time intervals following the time intervals at which address number 2 is provided to memory 21 for read out. This process of sequentially and repetitively reading through all the remaining 100 addresses of memory 21 continues for as long as output tones are desired. The numbers 0.9, 9 and 90 appearing on line 66 as phase increments at successive time intervals corresponding to addresses 1, 2 and 3 are applied through adder 38 as inputs to memory 25 which is repetitively accumulated at its respective addresses which are addressed in the same manner as is memory 21. Assuming that memory 25 was initially empty, the first pass through the addresses of memories 21, 25 will cause the numbers 0.9, 9 and 90 to be read into memory addresses 1, 2 and 3 of memory 25 and stored therein. On the second pass through the addresses of memories 21, 25, the contents of addresses 1, 2 and 3 of memory 25, in this case 0.9, 9, and 90, respectively, and the contents of addresses 1, 2, and 3, respectively, of memory 21, are sequentially added in adder 38 and provided as inputs to memory addresses 1, 2, and 3 of memory 25 and the numbers stored at addresses 1, 2 and 3 of memory 25 increases to 1.8, 18, and 180, respectively. The sequential outputs of adder 38 is the result of the accumulated phase increments in memory 25 and the phase increment provided by memory 21 which therefore results in an increase of a phase number on line 68 for each address 1, 2 and 3. These phase numbers are then applied in sequence to a memory 26 which stores the values of the sign wave where the sign values are stored for each number from 0 to 360 at the input to the memory 26. Thus, the first pass through memory 21 produces in sequence the numbers 0.9, 9 and 90 to memory sine 26 resulting in numerical outputs corresponding to the sine of 0.9, the sine of 9, and the sign of 90. The sequential outputs of the memory sine 26 corresponding to these sine values are multiplied in multiplier 44 by multiplying factors provided in the cells of memory as 24 at addresses 1 through 3, respectively. These values are added in accumulator 48 and stored in register 50. Accumulator 48 is reset at the beginning of the next sweep through the addresses of memory 21 to provide the values 1.8, 18 and 180 as the phase values on line 68 to be provided as sequential addresses to memory sine 26. The sine values provided by memory sine 26 are multiplied respectively by the contents of memory 24 in multiplier 44, accumulated in accumulator 48, and transferred to register 50 whose previous contents are cleared prior to storage of the new accumulated sine values. Thus, each pass of the address sequence through memory 21 provides a new value of accumulated sine values in register 50 over a time period corresponding to the period of a cycle of the 40 Hz tone provided by low pass filter 54. There will be stored in register 50 the sum of sampled 40, 400, and 4,000 hertz tones.

The memory 22, together with pseudo-random noise generator 42, randomly add or subtract smaller numbers in memory 22 to those larger numbers read out of memory 21 at corresponding addresses in order to provide to the memory sine 26 at each address a number which is not a linear phase accumulation (as described in the preceding paragraphs), and hence the ouput of memory sine 26 is not a uniformly sampled sine wave thereby providing at the output of the circuitry a spectrum-broadened set of tones corresponding to the 40, 400, and 4,000 Hz tones generated in the absence of the operation of memory 22, which condition was assumed in order to simplify the initial explanation of the invention.

The spectral-broadened 40, 400 and 4,000 Hz frequencies shown in display 62 represent these three frequencies showing the frequency-broadening provided by the contents of memory 22 in conjunction with the noise generator 42.

It is understood that the above-described embodiment of the invention is illustrative only and that modifications thereof may occur to those skilled in the art. Accordingly, it is desired that this invention is not to be limited to the embodiment disclosed herein but it to be limited only as defined by the appended claims.

What is claimed is:

1. A sound synthesizer comprising:

a first (21) and second (22) memory each containing a plurality of addresses, each address containing a numeral, the numeral of said second memory being smaller than the numeral contained in the corresponding address of said first memory;

addressing means (29) for repetitively providing a sequence of addresses to said first and second memories to provide a first and second sequence of numerals from corresponding addresses of said first and second memories respectively;

means (42) for providing a random sign bit to each of said sequence of numerals from said second memory to provide a polarized second numeral sequence;

first means (37) adding each of said first and said polarized second numerals of said first and second sequences;

a third memory (25) containing a plurality of addresses and corresponding storage cells and responsive to said addressing means (29) to provide a sequence of numerals from each of said addresses;

second means (38) for adding the read-out numeral contents of each storage cell at each address of said third memory (25) to the numeral of the corresponding address of the sequence of numerals provided by said first adding means (37);

said second adding means (38) having a modulo numeral sum output;

a fourth memory (26) containing sine values over the range of numerals of the same modulus as provided by said second adding means (38), said fourth memory being responsive to each numeral of the sequence of numerals provided by said second adding means (38) to provide a sequence of numerals representing the sine values of said numerals corresponding to said sequence of addresses;

a fifth memory (24) providing output numerals at its addresses corresponding to the addresses provided by said address providing means to thereby provide a succession of numerals;

means (44) multiplying the numerals of the succession of numerals of corresponding addresses of said fith memory (24) and of said fourth memory (26) to provide a succession of products;

means (48) accumulating each product of said succession of products to provide a final sum after each sequence of addresses to thereby provide a succession of final sums;

means (50) storing each said final sum value of said succession of final sums until replaced by the succeeding final sum to provide a synthesized sound.

2. The sound synthesizer of claim 1 wherein said means (48) for summing each product comprises a digital accumulator;

said means (50) for storing said summed product comprises a digital register, and comprising in addition:

a digital to analog converter (51) connected to said register for providing an analog signal; and a low-pass filter (54) connected to said converter (51) output to filter said analog signal and thereby provide a filtered synthesized sound.

* * * * *